US005460449A

United States Patent [19]

Kent et al.

[11] Patent Number: 5,460,449

[45] Date of Patent: Oct. 24, 1995

[54] IN-LINE MIXER FOR DISPERSIONS

[76] Inventors: J. Howard Kent, 5206 Sunderland Dr., Boise, Id. 83704; Gary L. Rohwer, 29575 Bar Diamond Lake, Parma, Id. 83660

[21] Appl. No.: 189,154

[22] Filed: Jan. 27, 1994

[51] Int. Cl.[6] ..... B01F 5/06

[52] U.S. Cl. ..... 366/336

[58] Field of Search ..... 366/336, 337, 366/338, 339, 340; 138/38, 42

[56] References Cited

U.S. PATENT DOCUMENTS

| | | | |
|---|---|---|---|
| 2,504,678 | 4/1950 | Gardner | 366/336 |
| 2,890,868 | 6/1959 | Potchen | 366/336 |
| 3,744,763 | 7/1973 | Schnoring et al. | 259/7 |
| 4,333,729 | 6/1982 | Marugg | 417/313 |
| 4,352,573 | 10/1982 | Pandolfe | 366/336 |
| 4,909,635 | 3/1990 | Lecoffre et al. | 366/337 |
| 4,944,602 | 7/1990 | Buschelberger | 366/337 |
| 5,145,256 | 9/1992 | Wiemers | 366/337 |

*Primary Examiner*—Robert W. Jenkins

*Attorney, Agent, or Firm*—Korfanta & Dunbar

[57] ABSTRACT

The invention is an in-line mixer without moving parts, with a generally conical shear head pointed in the upstream direction within a pipe, and centered near the downstream side of an annular seating ring fastened to the inside surface of the pipe. In the upstream, slanted face, or high pressure side of the shear head, there is a series of generally circular ports bored through the shear head. The slanted face of the conical shear head extends through the center of the seating ring in the upstream direction, and is adjusted to be located very close to the downstream side of the seating ring. At the downstream end of the slanted face of the shear head is a first sharp, approximately 90 degree edge leading away from the inside surface of the pipe in the downstream direction, which first edge is adjusted to be located very close to the inside surface of the pipe. This way, intense shearing forces are created at the edge of the downstream side of the annular seating ring near the inlets of the ports, and at the edge of the downstream end of the slanted face of the shear head near the inside surface of the pipe. Also, intense mixing forces are created at the downstream side of the annular seating ring near the inside surface of the pipe, and at the back of the shear head.

8 Claims, 5 Drawing Sheets

IN-LINE MIXER FOR DISPERSIONS

BACKGROUND OF THE INVENTION

1. Technical Field

This invention relates generally to mixers, and more specifically, to in-line mixers without moving parts. The mixer of this invention provides intense shearing and mixing forces from the energy of fluid mixtures passing through it and around it to provide stable, well-distributed dispersions, without the need for moving parts and without the entrainment of air into the dispersions.

2. Background Art

U.S. Pat. No. 3,744,763 (Schnöring et al.) discloses a homogenizing machine with a rotor, an end face of which has rings formed with recesses. The rotor rings revolve between similar rings arranged on the inside of the rotor housing to help create shearing and mixing forces and an emulsion therein.

U.S. Pat. No. 4,333,729 (Marugg) discloses a homogenizing unit with a conical bore hole and a conical plunger, the plunger having successive ring-shaped steps on it.

U.S. Pat. No. 4,909,635 (Lecoffre et al.) discloses a homogenizing machine with a perforated tubular insert having a solid diagonal baffle as a flow director in its center.

U.S. Pat. No. 4,944,602 (Buschelburger) discloses a homogenizing machine with a nozzle, a cutting edge between the inlet and the outlet, and downstream of the cutting edge, a circumferential recess. The mixture in the machine is subjected to an acceleration zone at the cutting edge, and a micro-turbulence zone in the circumferential recess.

Still, there is a need for an in-line mixer for dispersions which is of simple and inexpensive construction, without moving parts, and which operates without introducing air or gas bubbles into the dispersion.

DISCLOSURE OF INVENTION

The invention is an in-line mixer without moving parts, with a generally conical shear head pointed in the upstream direction within a fluid conduit or passageway, preferably a pipe, and centered near the downstream side of an annular seating ring fastened to the inside surface of the pipe. In the upstream, slanted face, or high pressure side, of the conical shaped flow mixer or shear head, there is a series of generally circular ports bored through the shear head generally parallel to the center-line of the seating ring and the pipe. The ports extend through the shear head to its downstream, or low pressure side.

The slanted face of the conical shear head extends partially through the center of the seating ring in the upstream direction, and is adjusted to be located very close, about 0.020 inches, to the downstream side of the seating ring when compounds such as cow blood and fat are being processed by the mixer. At the downstream end of the slanted face of the shear head is a first sharp, approximately 90 degree edge leading away from the inside surface of the pipe in the downstream direction, which first edge is adjusted to be located very close, about 0.004 inches, to the inside surface of the pipe when compounds such as cow blood and fat are being processed by the mixer. These clearances may vary slightly, depending on the composition, viscosity, percent solids, etc. of the liquid being processed by the mixer. The first sharp 90 degree edge transitions into a generally flat surface on the downstream, outside circumference of the shear head, which surface ends at a second sharp, approximately 90 degree edge leading away from the inside surface of the pipe, but in the upstream direction. The second, sharp 90 degree edge transitions into the back side of the shear head at approximately the location of the outlet of the ports in the shear head.

The ports in the slanted face of the shear head are arranged to be evenly spaced-apart in a ring around the center-line of the seating ring and pipe. Preferably, the center of each port is arranged to be at the same perpendicular distance from the inside surface of the pipe as the edge of the downstream side of the seating ring. The ports are sized, such that in a plane perpendicular to the longitudinal axis of the pipe, the sum of the cross sectional area of the ports is equal to the area between the pipe and the shear head.

As material flows through the mixer, intense shearing forces are created at the edge of the downstream side of the annular seating ring near the inlets of the ports, at the edge of the downstream end of the slanted face of the shear head near the inside surface of the pipe, and near the outlet of the ports.

BEST MODE FOR CARRYING OUT INVENTION

Figure 1:
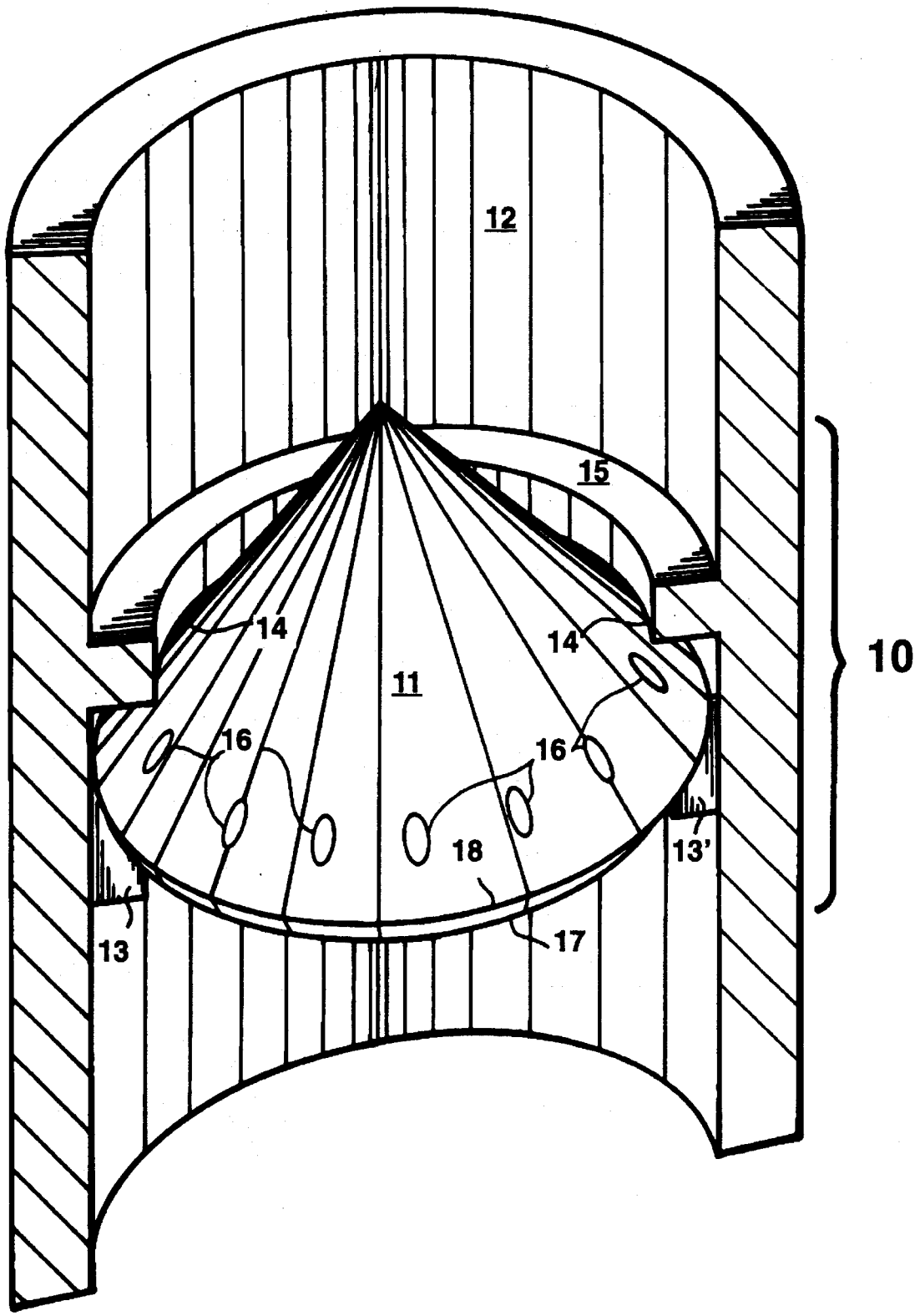
FIG. 1 is an isometric, partial cross-sectional view of one embodiment of the invention.
Figure 2:
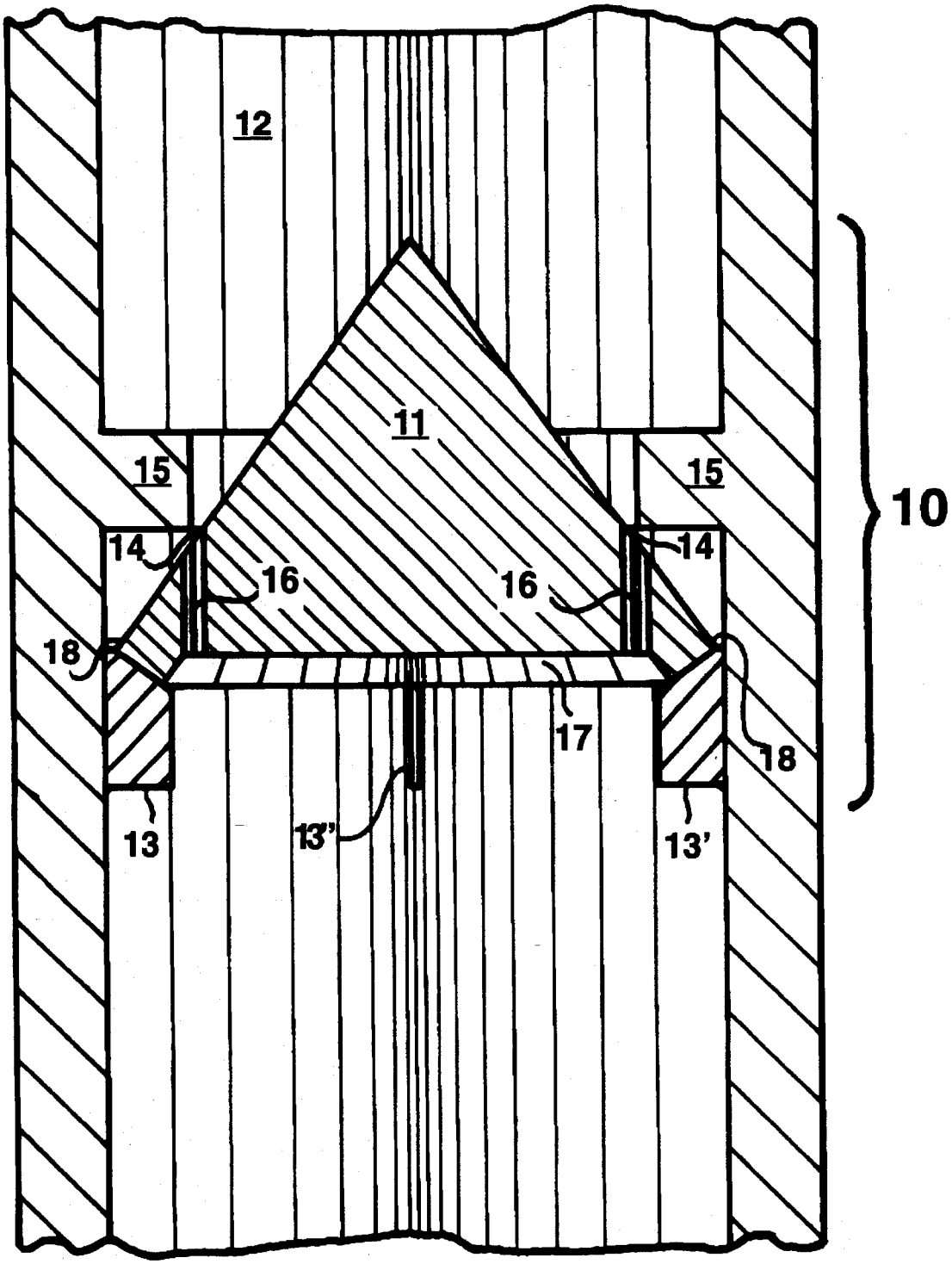
FIG. 2 is a side, cross-sectional view of the embodiment depicted in FIG. 1.
Figure 3:
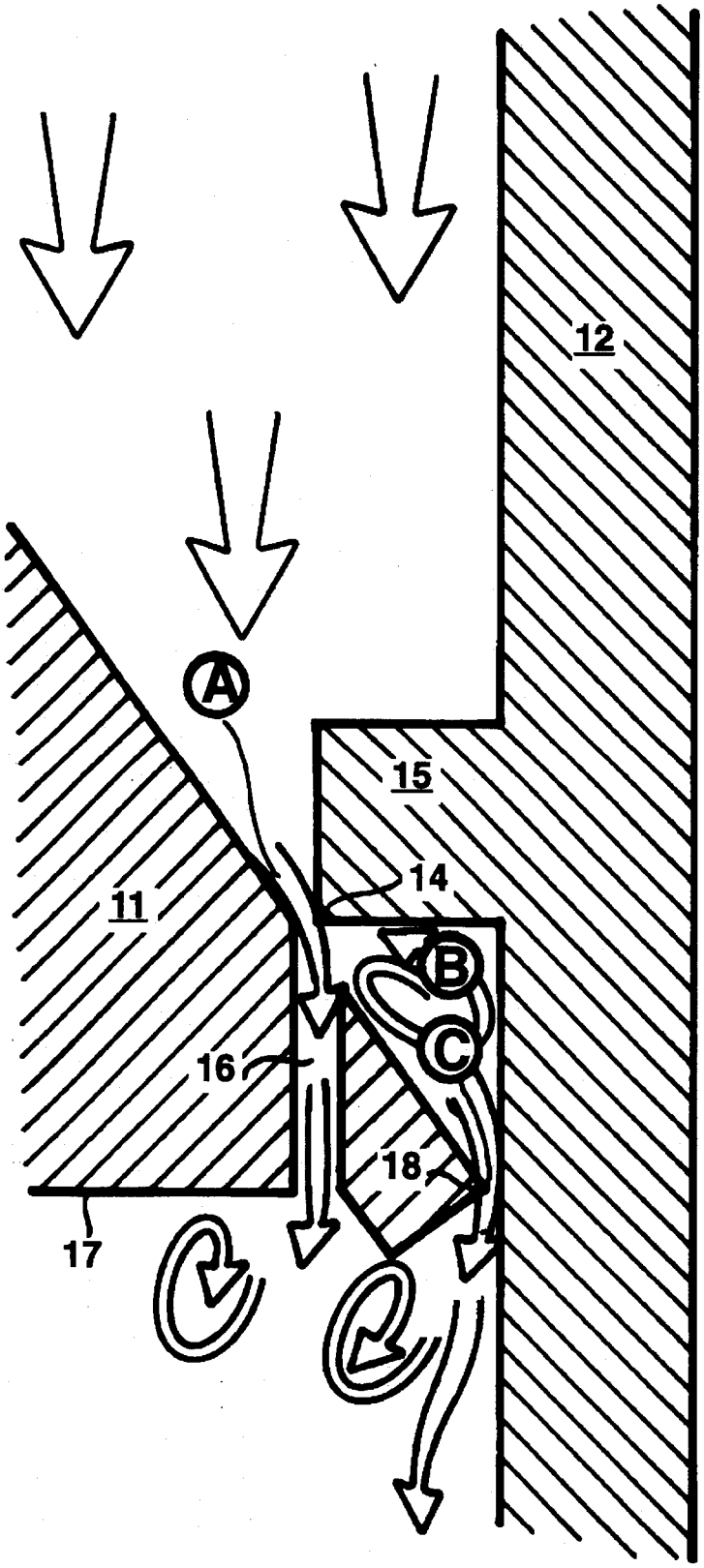
FIG. 3 is a schematic, partial, cross-sectional view of the embodiment depicted in FIGS. 1 and 2.

Referring to the FIGS. 1–3, there is depicted generally at 10 one embodiment of the in-line mixer of this invention. Mixer 10 has conical shear head 11 centered within a tubular housing or pipe 12 around which unmixed material is passed, thus shearing the unmixed material to generate mixed material. The pointed end or conical face of shear head 11 is colocated along the longitudinal axis of the pipe, which can be seen in FIGS. 1, 2 and 5 and directed upstream relative to material flow through pipe 12. Lugs 13, 13', and 13" are welded to the downstream or base surface of the shear head 11 and are subsequently welded to the inside surface of the pipe 12 in order to hold shear head 11 securely within the pipe 12 and centered in the passageway. Slightly upstream of lugs 13, 13' and 13" is annular ring 15 on the inside surface of pipe 12 which provides an obstruction to material flow through the pipe 12. Ring 15 has a sharp, downstream inner edge 14. Shear head 11 is positioned so that the surface of its upstream, slanted face is very close to the downstream, inner edge 14 of annular seating ring 15 as seen in FIGS. 1–3.

The upstream side of annular seating ring 15 may also incorporate a smooth, tapered transition from the inside surface of pipe 12 to the upstream, inner edge of the ring. This way, pressure drop and residence time for the fluid entering the mixer may be minimized. However, if high pressure drop is not a problem for the particular mixing process, or if it is desired to maximize turbulence and residence time at the entrance to the mixer, a rectangular, annular ring, with sharp upstream and downstream inner edges as depicted in FIGS. 1–3 and 5, may be used.

The slanted face or cone portion of shear head 11 extends through the center of annular seating ring 15 in the upstream direction, and is positioned to be located very close, about 0.020 inches away, to the downstream, inner edge 14 of seating ring 15 when compounds such as cow blood and fat are being processed by the mixer, for example. Referring to FIG. 3, as material passes through the mixer 10, a first mixing zone is created in the area denoted Region A wherein high shear force is created at the upstream, inner edge 14 of seating ring 15 when fluid in pipe 12 passes between edge 14 and the upstream face of shear head 11. The size of the first mixing zone denoted Region A may be varied by locating the slanted face of shear head 11 nearer to or farther from the downstream, inner edge 14 of seating ring 15. Depending upon the composition, viscosity, percent solids, etc., efficient mixing may be obtained by adjusting the clearance between the annular ring 15 and shear head 11.

In the upstream, slanted face of the shear head 11 there are a series of generally cylindrical bypass ports 16 bored through the shear head generally parallel to the center-line of the seating ring 15 and pipe 12, as shown in FIG. 1–3. The ports 16 extend through the shear head 11 from its upstream side to its downstream side, or back 17, thereby bypassing mixing region C as shown in FIG. 3. The ports 16, which may number from about five to about twenty, are arranged radially and generally evenly-spaced apart. Preferably, the center of each port 16 is located so that it is at the same perpendicular Distance B from the inside surface of pipe 12 as the downstream, inner edge 14 of seating ring 15. It is important to note the distance B to the center of the ports 16 and the downstream edge 14 may be varied in order to create more or less turbulence at the inlet to the ports 16, with more turbulence being developed with greater relative distance B.

At the downstream end of the slanted face of shear head 11 is a first sharp, approximately 90 degree edge 18 leading away from the inside surface of pipe 12 in the downstream direction, as can be seen in FIG. 3. This first sharp edge 18 is adjusted to be located very close, about 0.004 inches from the inside surface of pipe 12. The inside surface of pipe 12, mixer 11, and ring 15 thus define a cross-sectional area, Region C, wherein high shear force is created at the sharp edge 18 as fluid passes through the mixer, as can be seen in FIG. 3. The size of Region C may be varied by locating the first sharp edge 18 nearer to or farther from the inside surface of pipe 12. This way, depending upon the composition, viscosity, percent solids, etc. of the liquid being processed by the mixer, efficient mixing may still be obtained by varying the intensity of the shear force in Region A, with additional shear force being generated within the smaller Region C.

The ports 16 are sized so that the sum of their cross-sectional area in a plane perpendicular to the center-line of the seating ring 15 and pipe 12 is approximately equal to the area of the annular space, Region C, between the first sharp edge 18 of shear head 11 and the inside surface of pipe 12.

Preferably, the component parts of the mixer of this invention are precision machined to fit and cooperate together exactly. For example, first the inside surface of pipe 12 is machined to ensure that it is perfectly round and of an exact diameter. Then, seating ring 15 is machined to ensure also that it is perfectly round and of an exact diameter. The exact location of seating ring 15 within pipe 12 may be ensured by, for example, machining a circumferential ledge into the inside surface of pipe 12 to act as a stop for seating ring 15.

Then, the exact location of shear head 11 relative to seating ring 15 may be ensured by first tack welding lugs 13, 13' and 13" to shear head 11, and then tack welding the lugs to the inside surface of pipe 12. At this point, care must be exercised to maintain the exact distance between the slanted face of shear head 11 and the downstream, inner edge 14 of seating ring 15, and at the same time the exact distance between first, sharp edge 18 and the inside surface of pipe 12. Similar care must also be exercised in manufacturing the conical shear head 11 and ports 16. This way, the component parts of the mixer will cooperate together to provide the intense shear and mixing forces necessary to make good dispersions.

Figure 4:
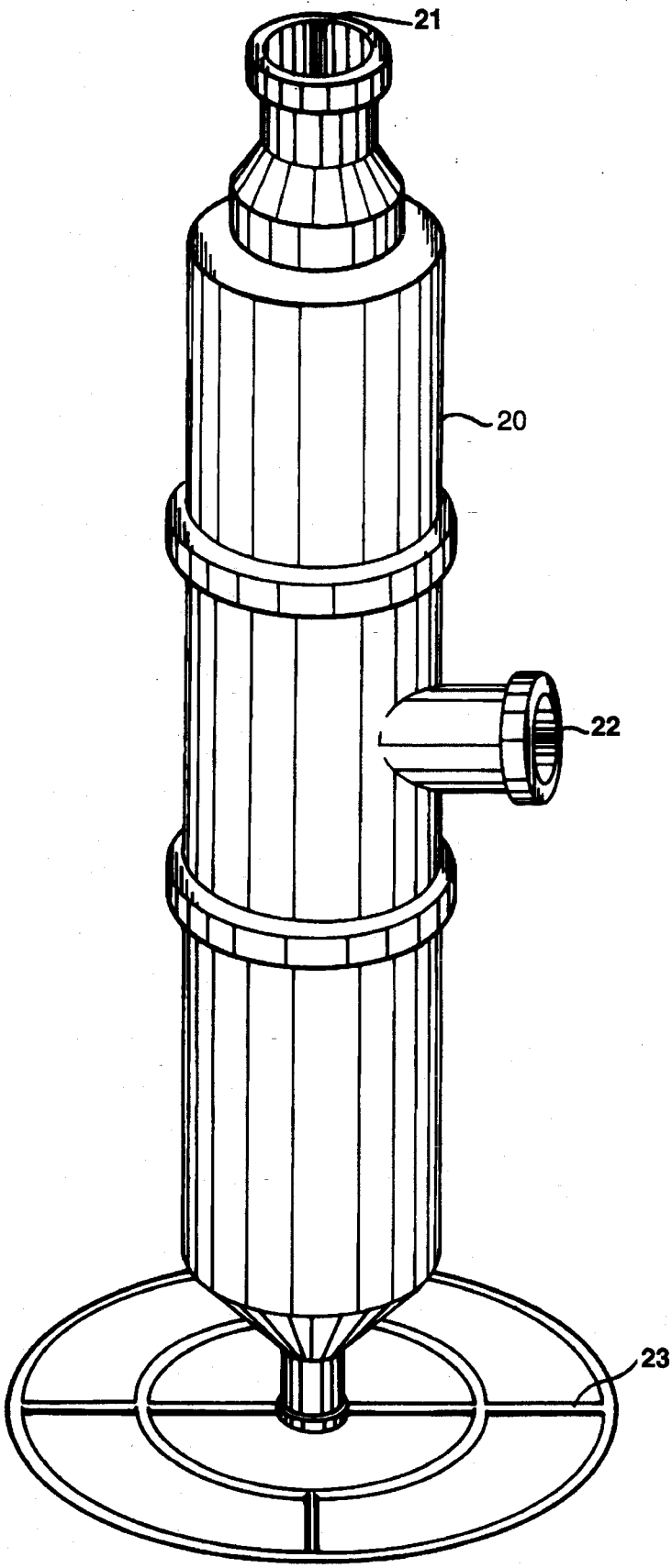
FIG. 4 is an isometric view of another embodiment of the invention.
Figure 5:
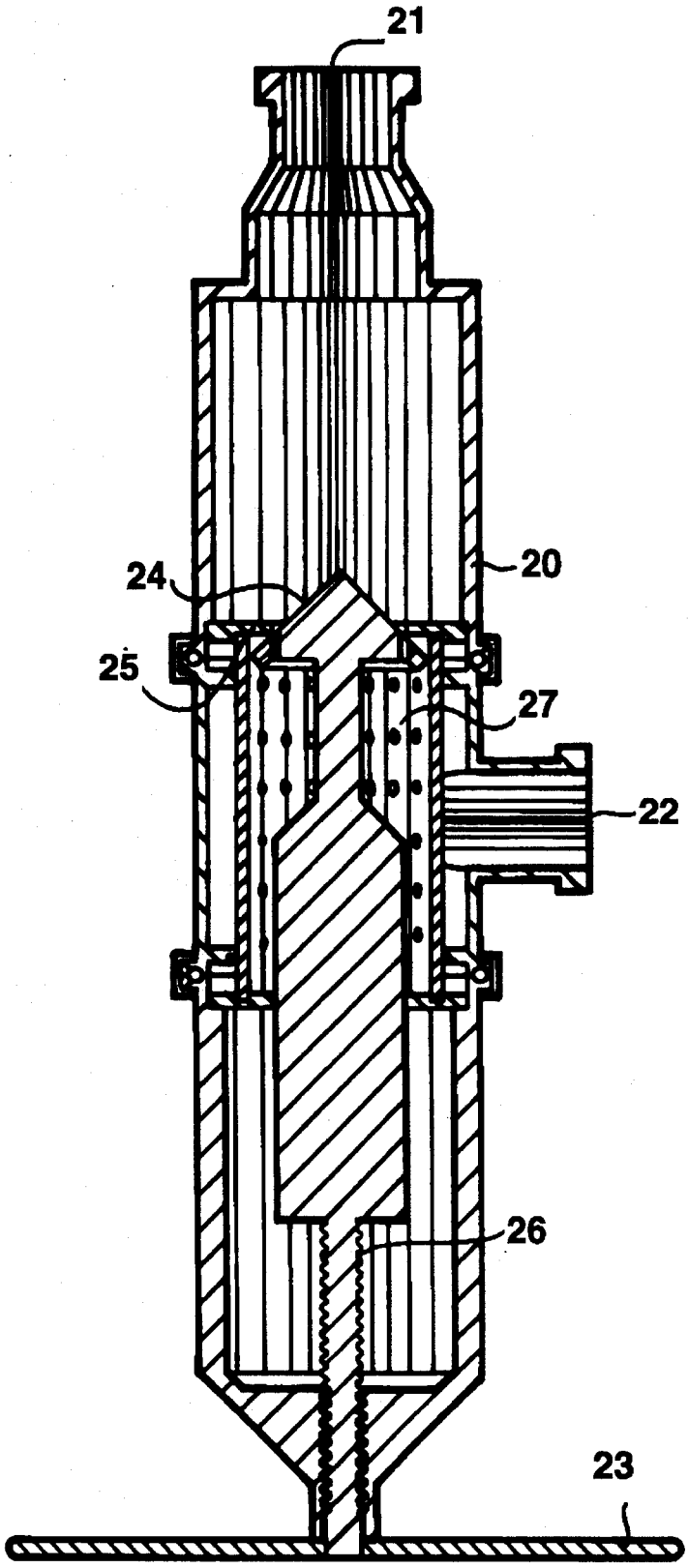
FIG. 5 is a cross-sectional, side view of the embodiment depicted in FIG. 4.

Generally, high-grade pipe fitting and machining materials and techniques will suffice for manufacturing the mixer of this invention, depending on the intended use of the resulting dispersion. For food grade applications, for example, all the parts must be stainless steel, and they must be readily disassembled for cleaning. For other industrial applications, carbon steel may suffice. We prefer to use stainless steel materials, for example 316 stainless, schedule 80 pipe for the pipe section 12. Also, depending on the application, we prefer similar materials for the shear head 11 and seating ring 15. These components of the mixer of this invention may be manufactured and assembled by conventional techniques, provided the care described above is given to the methods. An alternative embodiment 20 of the mixer of this invention is depicted in FIGS. 4 and 5. This mixer has an inlet section 21 and an outlet section 22. Also, it has an adjustment mechanism 23 for adjusting the distance between the upstream, slanted face of its shear head 24 and its seating ring 25. This way, different liquids may be processed by the mixer, and different Region A's, Distances B and Region C's provided in the mixer, by simply adjusting the travel of shaft 26 connected between adjustment mechanism 23 and shear head 24. Optionally in this embodiment, annular perforated mixing basket 27 may also be used to provide additional mixing of the liquid after it has passed shear head 24 and seating ring 25, or to provide primary mixing if shaft 26 is withdrawn all the way to remove shear head 24 from within seating ring 25.

While there is shown and described the present preferred embodiment of the invention, it is to be distinctly understood that this invention is not limited thereto but may be variously embodied to practice within the scope of the following claims.

I claim:

1. An apparatus for mixing comprising;

a) a tubular housing of known inside diameter having an inside surface, an upstream end for receiving unmixed material, and a downstream end for disgorging mixed material, said ends defining a longitudinal axis;

b) an annular obstruction fixedly attached to the inside surface of said tubular housing for reducing the cross-sectional area inside of said tubular housing and accelerating material flow;

c) a cone shaped flow mixer comprising;

a pointed end, a conical face, and a base end, wherein the flow mixer is symmetric about a central axis defined by the pointed end and a line perpendicular to the base end; said flow mixer rigidly positioned within said tubular housing, wherein the central axis of the flow mixer is coincident with the centerline of the longitudinal axis of the housing, oriented with the pointed end directed upstream, said flow mixer positioned downstream of said annular obstruction, said annular obstruction enveloping said flow mixer defining a first mixing zone within the annular obstruction which communicates with the upstream end and second mixing zone, and a second mixing zone within the confines of the pipe and flow mixer downstream of said annular obstruction which communicates with said first mixing zone and downstream housing end.

2. The apparatus of claim 1 wherein said flow mixer further comprises a plurality of cylindrical bypass ports formed therethrough extending from the conical face to the base end of the flow mixer, radially disposed about the central axis, parallel to said central axis for bypassing material past said second mixing zone.

3. The apparatus of claim 2 wherein said flow mixer is adjustably positioned within said tubular housing such that it may be displaced along the longitudinal axis for the purpose of altering the clearance between said flow mixer and said annular obstuction.

4. The apparatus of claim 1 wherein said flow mixer is adjustably positioned within said tubular housing such that it may be displaced along the longitudinal axis for the purpose of altering the clearance between said flow mixer and said annular obstruction.

5. A hydraulic shear mixer assembly which comprises:

a housing having a longitudinal passageway of known diameter therethrough for the passage of liquids and suspended particulates from an upstream end to a downstream end;

an annular shaped flow restrictor for accelerating said liquids and suspended particulates having a central opening, attached within said passageway, with its central opening in alignment with the longitudinal passageway;

a conical shaped flow mixer having a major diameter less than that of said passageway positioned downstream of said annular shaped flow restrictor, fixed in proximity to said annular shaped flow restrictor thus defining a mixing zone wherein liquids and suspended particulates are accelerated through said annular shaped flow restrictor and around said conical flow mixer thereby inducing high shearing forces and mixing said liquids and suspended particulates; wherein said flow mixer further has a plurality of cylindrical bypass ports formed therethrough extending from the conical face to the base end of the flow mixer, radially disposed about the central axis, parallel to said central axis for bypassing material past the first mixing zone.

6. The apparatus of claim 5 wherein mixing is achieved without inducing air bubbles into said mixing zone.

7. The apparatus of claim 5 wherein said flow mixer further comprises a plurality of cylindrical bypass ports formed therethrough extending from the conical face to the base end of the flow mixer, radially disposed about the central axis, parallel to said central axis for bypassing material past the first mixing zone.

8. The apparatus of claim 5 wherein said flow mixer is adjustably positioned within said tubular housing such that it may be displaced along the longitudinal axis for the purpose of altering the clearance between said flow mixer and said annular ring.

* * * * *